US009920388B2

(12) United States Patent
Ramello et al.

(10) Patent No.: US 9,920,388 B2
(45) Date of Patent: Mar. 20, 2018

(54) PROCESS FOR THE PRODUCTION OF SUGARS FROM BIOMASS

(71) Applicant: versalis S.p.A., San Donato Milanese (MI) (IT)

(72) Inventors: Stefano Ramello, Novara (IT); Rossella Bortolo, Novara (IT)

(73) Assignee: versalis S.p.A., San Donato Milanese (MI) (IT)

( * ) Notice: Subject to any disclaimer, the term of this patent is extended or adjusted under 35 U.S.C. 154(b) by 0 days.

(21) Appl. No.: 15/027,193

(22) PCT Filed: Dec. 10, 2014

(86) PCT No.: PCT/IB2014/066759
§ 371 (c)(1),
(2) Date: Apr. 4, 2016

(87) PCT Pub. No.: WO2015/087254
PCT Pub. Date: Jun. 18, 2015

(65) Prior Publication Data

US 2016/0237513 A1 Aug. 18, 2016

(30) Foreign Application Priority Data

Dec. 11, 2013 (IT) ..... MI2013A002069

(51) Int. Cl.

| | |
|---|---|
| ***C13K 1/00*** | (2006.01) |
| ***C13K 1/02*** | (2006.01) |
| ***C13K 1/06*** | (2006.01) |
| ***C13K 13/00*** | (2006.01) |

(52) U.S. Cl.
CPC ..... *C13K 1/02* (2013.01); *C13K 1/06* (2013.01); *C13K 13/002* (2013.01)

(58) Field of Classification Search
CPC ..... C13K 1/02
See application file for complete search history.

(56) References Cited

U.S. PATENT DOCUMENTS

| | | | | |
|---|---|---|---|---|
| 6,007,636 | A | 12/1999 | Lightner | |
| 8,460,901 | B2 * | 6/2013 | Marzialetti | C12P 7/10 127/37 |
| 8,524,924 | B2 * | 9/2013 | Burket | C07D 307/50 549/488 |
| 2009/0062524 | A1 | 3/2009 | Massonne et al. | |
| 2009/0198046 | A1 | 8/2009 | Fanselow et al. | |
| 2010/0200182 | A1 | 8/2010 | Li | |
| 2012/0029247 | A1 | 2/2012 | Holbrey et al. | |
| 2012/0116068 | A1 | 5/2012 | Stegmann et al. | |
| 2013/0034891 | A1 | 2/2013 | Fanselow et al. | |

FOREIGN PATENT DOCUMENTS

| | | |
|---|---|---|
| EP | 1 860 201 A1 | 11/2007 |
| WO | WO 2010/069583 A1 | 6/2010 |
| WO | WO 2013/127006 A1 | 9/2013 |

OTHER PUBLICATIONS

Tsoutos et al, Optimization of the Dilute Acid Hydrolyzator for Cellulose-to-Bioethanol Saccharification, 2011, energies, 4, pp. 1601-1623.*

Burla et al, Two-Step Production of 1,3-Butadiene From Ethanol, 2012.*

International Search Report dated Feb. 17, 2015 in PCT/IB2014/066759.

* cited by examiner

*Primary Examiner* — Melvin C Mayes
*Assistant Examiner* — Stefanie Cohen
(74) *Attorney, Agent, or Firm* — Oblon, McClelland, Maier & Neustadt, L.L.P.

(57) ABSTRACT

Process for the production of sugars from biomass including at least one polysaccharide which comprises putting a biomass in contact with an aqueous solution of at least one organic acid having from 1 to 6 carbon atoms, preferably from 1 to 3 carbon atoms, the pH of said aqueous solution being ranging from 0.6 to 1.6, preferably ranging from 0.9 to 1.3. The sugars thus obtained can be advantageously used as carbon sources in fermentation processes for the production of alcohols (e.g., ethanol, butanol), diols (e.g., 1,3-propanediol, 1,3-butanediol, 1,4-butanediol, 2,3-butanediol), lipids, or other intermediates or products. Said alcohols, diols, lipids, or other intermediates or products, can be advantageously used in the chemical industry or in the formulation of fuels for motor vehicles. Said alcohols and said diols can also be advantageously used in the bio-butadiene production.

16 Claims, No Drawings

PROCESS FOR THE PRODUCTION OF SUGARS FROM BIOMASS

The present invention relates to a process for the production of sugars from biomass including at least one polysaccharide.

More specifically, the present invention relates to a process for the production of sugars from biomass including at least one polysaccharide which comprises putting a biomass in contact with an aqueous solution of at least one organic acid having from 1 to 6 carbon atoms, preferably from 1 to 3 carbon atoms, the pH of said aqueous solution being ranging from 0.6 to 1.6, preferably ranging from 0.9 to 1.3.

The sugars thus obtained can be advantageously used as carbon sources in fermentation processes for the production of alcohols (e.g., ethanol, butanol), diols (e.g., 1,3-propanediol, 1,3-butanediol, 1,4-butanediol, 2,3-butanediol), lipids, or other intermediates or products. Said alcohols, diols, lipids, or other intermediates or products, can be advantageously used in the chemical industry or in the formulation of fuels for motor vehicles. Said alcohols and said diols can also be advantageously used in the bio-butadiene production.

The production of sugars from biomass, in particular lignocellulosic biomass, is known in the art.

Lignocellulosic biomass is a complex structure comprising three main components: cellulose, hemicellulose and lignin. Their relative quantities vary according to the type of lignocellulosic biomass used. For example, in the case of plants, said quantities vary according to the species and the age of the plant.

Cellulose is the major constituent of lignocellulosic biomass and is generally present in quantities ranging from 30% by weight to 60% by weight with respect to the total weight of the lignocellulosic biomass. Cellulose consists of glucose molecules (from about 500 to 10,000 units) bound to each other through a β-1,4 glucoside bond. The establishment of hydrogen bonds between the chains causes the formation of crystalline domains which give resistance and elasticity to vegetable fibres. In nature, it can only be found in its pure state in annual plants such as cotton and flax, whereas in ligneous plants it is always accompanied by hemicellulose and lignin.

Hemicellulose, which is generally present in a quantity ranging from 10% by weight to 40% by weight with respect to the total weight of the lignocellulosic biomass, appears as a mixed polymer, relatively short (from 10 to 200 molecules) and branched, composed of both sugars with six carbon atoms (glucose, mannose, galactose) and also sugars with five carbon atoms (xylose, arabinose). Some important properties of vegetable fibres are due to the presence of hemicellulose, of which the main property is that of favouring the imbibition of said vegetable fibres, when water is present, causing swelling. Hemicellulose also has adhesive properties and therefore tends to harden or to develop a horny consistency, with the consequence that said vegetable fibres become rigid and are imbibed more slowly.

Lignin is generally present in a quantity ranging from 10% by weight to 30% by weight with respect to the total weight of the lignocellulosic biomass. Its main function consists in binding and cementing the various vegetable fibres together giving the plant compactness and resistance, and also provides protection against insects, pathogen agents, lesions and ultraviolet light. It is mainly used as fuel but is also currently widely used in industry as a disperser, hardener, emulsifying agent, for plastic laminates, cartons and rubber products. It can also be chemically treated to produce aromatic compounds, of the vanillin, syringaldehyde, p-hydroxybenzaldehyde type, which can be used in pharmaceutical chemistry, or in the cosmetic and food industry.

In order to optimize the transformation of lignocellulosic biomass into products for energy use, subjecting said biomass to a preliminary treatment is known, in order to separate the lignin and to hydrolyze the cellulose and hemicellulose to simple sugars such as, for example, glucose and xylose, which can then be subjected to fermentation processes.

The process normally used for the above purpose is acid hydrolysis, which can be carried out in the presence of diluted or concentrated strong acids.

American U.S. Pat. No. 6,423,145, for example, describes a process for hydrolyzing a lignocellulosic biomass so as to obtain a high quantity of fermentable sugars which comprises: impregnating the lignocellulosic material with a mixture comprising a diluted acid catalyst (for example, sulfuric acid, hydrochloric acid, nitric acid, sulfur dioxide, or any other strong acid capable of giving pH values lower than about 3) and a catalyst based on a metal salt (for example, ferrous sulfate, ferric sulfate, ferric chloride, aluminium sulfate, aluminium chloride, magnesium sulfate), in such a quantity as to provide a higher yield of fermentable sugars with respect to that obtained in the presence of diluted acid alone; feeding the impregnated lignocellulosic material to a reactor and heating (for example, to a temperature ranging from 120° C. to 240° C.) for a time (for example, for a time ranging from 1 minute to 30 minutes) sufficient for substantially hydrolyzing all of the hemicellulose and over 45% of the cellulose to sugars soluble in water; recovering the sugars soluble in water.

International patent application WO 2010/102060 describes a process for the pre-treatment of biomass to be used in a biorefinery for producing a fermentation product, which comprises the following steps: subjecting the biomass to treatment (for example, removal of undesired materials, grinding) before sending it to pre-treatment; subjecting the biomass to pre-treatment by applying a diluted acid (for example, sulfuric acid) having a concentration ranging from about 0.8% by weight to about 1.1% by weight, at a temperature ranging from about 130° C. to about 170° C., for a time ranging from about 8 minutes to about 12 minutes; wherein the fermentation product can be obtained by separating the pre-treated biomass into a liquid component comprising xylose and into a solid component from which glucose can be obtained, and recovering the xylose for fermentation; wherein the biomass comprises lignocellulosic material; wherein the lignocellulosic material comprises corn cobs, corn plant husks, corn plant leaves and corn plant stalks.

International patent application WO 2010/071805 describes a process for pre-treating lignocellulosic material which comprises: subjecting the lignocellulosic material to a first pre-treatment carried out under low-severity operating conditions obtaining a first product; putting said first product in contact with a diluted acid in aqueous solution (for example, sulfuric acid, sulfurous acid, sulfur dioxide, phosphoric acid, carbonic acid) obtaining a second product. Said two-step process can provide products useful for the production of bioethanol.

American patent application US 2010/0227369 describes a method for producing a fermentation product in a fermentation system from biomass which has been pre-treated and separated into a first component and into a second component, which comprises the following steps: feeding the first component to a fermentation system; providing the fermentation system with an organism capable of producing ethanol ("ethanologen"); maintaining the first component and the organism capable of producing ethanol ("ethanologen") in the fermentation system at a temperature ranging from about 26° C. to about 37° C. and at a pH ranging from about 4.5 to about 6.0, for a time not less than 18 hours; recovering the fermentation product from the fermentation system; wherein the organism capable of producing ethanol ("ethanologen") is fed to the fermentation system in a quantity lower than 150 grams of organism capable of producing ethanol ("ethanologen") (dry weight) per liter of first component; wherein the biomass comprises lignocellulosic material; wherein the lignocellulosic material comprises at least one of the following: corn cobs, corn plant husks, corn plant leaves and corn plant stalks; wherein the first component comprises a pentose; wherein the pentose comprises xylose; wherein the organism capable of producing ethanol ("ethanologen") is capable of fermenting the xylose to ethanol. The pretreatment of the biomass is preferably carried out by putting said biomass in contact with an acid such as, for example, sulfuric acid, hydrochloric acid, nitric acid, phosphoric acid, acetic acid, or mixtures thereof.

American patent application US 2008/0274509 describes a process for preparing a hydrolyzed product from a lignocellulosic material which comprises: a) pre-treating said lignocellulosic material with a compound selected from the group consisting of: sulfuric acid, alkalis, peroxodisulfates, potassium peroxide, and mixtures thereof, in the presence of water, obtaining an aqueous phase; and b) after removal of the aqueous phase and the washing of the obtained product, treating said product with an enzyme useful for hydrolysis, in the presence of water, obtaining a hydrolyzed product, said hydrolyzed product being suitable as a carbon source for fermentation.

Tsoutsos T. et al., in "Energies" (2011), Vol. 4, pages 1601-1623, describe the optimization of the production of solutions of fermentable sugars for the production of bioethanol from lignocellulosic biomass. In this respect, the lignocellulosic biomass is subjected to a two-step hydrolysis process, in the presence of a diluted acid. In particular, tests were carried out in the presence of acids (for example, hydrochloric acid, sulfuric acid, phosphoric acid, nitric acid) diluted to a concentration of up to 3%-4% and at temperatures ranging from 100° C. to 240° C. The hydrolysis of the hemicellulose takes place at temperatures ranging from 110° C. to 140° C., whereas the crystalline cellulose remains practically as such up to 170° C. and is hydrolyzed at 240° C.

Gonzáles-Hernandez J. C. et al., in "Journal of the Mexican Chemical Society" (2011), Vol. 56 (4), pages 395-401, describe the hydrolysis of polysaccharides from tamarind seeds. In particular, the tamarind seeds were subjected to hydrolysis operating under varying operating conditions: i.e. at a temperature ranging from 86° C. to 130.2° C.; at a concentration of nitric acid or of sulfuric acid ranging from 0.32% to 3.68% (v/v); and with a contact time ranging from 13.2 minutes to 40 minutes. It was observed that the temperature and the time are factors that mainly influence the hydrolysis of sugars: in particular, the best operating conditions, for both acids, were: temperature equal to 130.2° C., concentration equal to 2% (v/v), contact time 30 minutes, with a yield of sugars equal to about 110 g/l.

Shatalov A. A. et al., in "Chemical Engineering & Process Technology" (2011), Vol. 2, Issue 5, pages 1-8, describe the production of xylose, by hydrolysis in the presence of diluted sulfuric acid, at low temperature, in a single step, from thistle (*Cynara cardunculus* L.). In particular, when operating under optimum conditions, i.e. temperature equal to 138.5° C., time equal to 51.7 minutes, concentration of the acid equal to 1.28%, there is a recovery of xylose equal to 86%, with a low degradation of the cellulose and a low production of furfurals (glucose=2.3 g and furfural (F) 1.04 g per 100 g of thistle).

The processes described above, however, can have some drawbacks.

If, for example, the acid hydrolysis is carried out at high temperatures, for example higher than 140° C., reaction by-products can be formed, deriving from the dehydration of the sugars and from the partial depolymerization of the lignin, such as, for example furfural (F), hydroxy-methylfurfural (HMF), phenolic compounds, which act as growth inhibitors of the microorganisms normally used in the subsequent fermentation processes of sugars, causing a significant reduction in the efficiency and in the productivity of these processes.

If, on the contrary, the acid hydrolysis is carried out at low temperatures, for example lower than 140° C., a limited destructuring of the lignocellulosic biomass can be obtained, said destructuring being necessary for freeing the cellulose fibres from the lignin lattice which is covering them to allow them to be advantageously used in the subsequent enzymatic hydrolysis step. It is in fact difficult for the enzymes usually used (for example, cellulase) in the enzymatic hydrolysis to reach the cellulose fibres covered by lignin.

Attempts have in fact been made in the art to overcome the above drawbacks.

International patent application WO 2010/069583, for example, describes a process for the production of one or more sugars from biomass including at least one polysaccharide which comprises putting a biomass in contact with an aqueous solution of at least one organic acid, preferably p-toluene-sulfonic acid, 2-naphthalene-sulfonic acid, 1,5-naphthalene-disulfonic acid, at a temperature higher than or equal to 160° C., preferably ranging from 160° C. to 230° C. In said patent application, alkyl-sulfonic acids having from 4 to 16 carbon atoms, preferably from 8 to 12 carbon atoms, are also mentioned, even more preferably octyl-sulfonic acid and dodecyl-sulfonic acid. The only examples of hydrolysis reported, however, relate to the use of 2-naphthalene-sulfonic acid.

International patent application WO 2010/015404 describes a process for the production of sugars from biomass including at least one polysaccharide which comprises putting a biomass in contact with an aqueous solution of at least one organic acid having from 7 to 20 carbon atoms, preferably from 9 to 15 carbon atoms, more preferably p-toluene-sulfonic acid, 2-naphthalene-sulfonic acid, 1,5-naphthalene-disulfonic acid, at a temperature ranging from 80° C. to 140° C., preferably ranging from 100° C. to 125° C.

The Applicant has observed however that not always does the use of the organic acids described above allow the desired results to be obtained, in particular in terms of yield of sugars and of production of by-products.

The Applicant has therefore considered the problem of finding a process for the production of sugars from biomass capable of giving a high conversion of the hemicellulose component and consequently a high yield of sugars having from 5 to 6 carbon atoms, in particular sugars having 5 carbon atoms such as xylose, arabinose (i.e. a yield of sugars having from 5 to 6 carbon atoms higher than or equal to 95%, said yield being calculated with respect to the total quantity of hemicellulose contained in the starting biomass)

and a low quantity of by-products [e.g., furfural (F), hydroxy-methyl-furfural(HMF)] (i.e. a quantity of by-products lower than or equal to 3%, said quantity being calculated as described hereunder.

The Applicant has now found that the production of sugars from biomass, in particular from biomass including at least one polysaccharide, can be advantageously carried out by means of a process which comprises putting a biomass in contact with an aqueous solution of at least one organic acid having from 1 to carbon atoms, preferably from 1 to 3 carbon atoms, the pH of said aqueous solution being ranging from 0.6 to 1.6, preferably ranging from 0.9 to 1.3.

Numerous advantages are obtained with said process. Said process, for example, allows to obtain a high conversion of the hemicellulose component and consequently a high yield of sugars having from 5 to 6 carbon atoms, in particular sugars having 5 carbon atoms such as xylose, arabinose (i.e. a yield of sugars having from 5 to 6 carbon atoms higher than or equal to 95%, said yield being calculated with respect to the total quantity of hemicellulose contained in the starting biomass), deriving from the acid hydrolysis of said biomass, which can be subsequently used as carbon source in fermentation processes for the production of alcohols (e.g., ethanol, butanol), diols (e.g., 1,3-propanediol, 1,3-butanediol, 1,4-butanediol, 2,3-butanediol), lipids, or other intermediates or products. Said alcohols, diols, lipids, or other intermediates or products, can be advantageously used in the chemical industry or in the formulation of fuels for motor vehicles. Said alcohols and said diols can also be advantageously used in the bio-butadiene production.

Furthermore, the possibility of obtaining a high conversion of the hemicellulose component and consequently a high yield of sugars having from 5 to 6 carbon atoms, in particular sugars having 5 carbon atoms such as xylose, arabinose, allows to send to subsequent fermentation solutions of sugars particularly rich in sugars having 5 carbon atoms, or mixtures of said solutions of sugars particularly rich in sugars having 5 carbon atoms with solutions particularly rich in sugars having 6 carbon atoms (for example, with solutions of sugars deriving from the enzymatic hydrolysis of cellulose) and, consequently, to optimize said fermentation processes. It is known, in fact, that the microorganisms used in fermentation give a fermented biomass having different characteristics in terms, for example, of accumulation of intermediate products, accumulation of undesired metabolic products, depending on the sugars supplied in the feeding. It is also known that the microorganisms used in fermentation processes are sensitive to the feeding: some strains of microorganism, for example, do not tolerate an excessive quantity of sugars having 5 carbon atoms. It is therefore extremely advantageous to be able to have two different types of sugar solutions, i.e. solutions of sugars particularly rich in sugars having 5 carbon atoms, and also solutions of sugars particularly rich in sugars having 6 carbon atoms, to allow said solutions of sugars to be destined to different fermentation processes and, consequently, to optimize said fermentation processes thanks to a greater congruency with respect to the nourishment requirements of the different strains of microorganisms.

It is also to be noted that the quantity of sugars having from 5 to 6 carbon atoms obtained from the hydrolysis of hemicellulose, depends on the type of starting biomass: it is known, in fact, as already mentioned above, that the quantity of cellulose, hemicellulose and lignin components varies according to the type of biomass.

Said process, moreover, also allows a wide temperature range to be adopted (i.e. within a range of 100° C. to 180° C.), obtaining, also at high temperatures (i.e. temperatures higher than or equal to 140° C.), a low quantity of by-products [e.g., furfural (F), hydroxy-methyl-furfural (HMF)] which, as reported above, act as growth inhibitors of the microorganisms usually used in the subsequent fermentation processes of sugars.

Furthermore, the possibility of operating within said wide temperature range represents a considerable advantage from an industrial point of view as unexpected temperature increases inside the reactors in which the biomass is put in contact with the aqueous solution of at least one organic acid, do not cause, as is generally the case in the processes of the known art, a greater production of by-products [e.g., furfural (F), hydroxy-methyl-furfural (HMF)].

An object of the present invention therefore relates to a process for the production of sugars from biomass including at least one polysaccharide which comprises putting a biomass in contact with an aqueous solution of at least one organic acid having from 1 to carbon atoms, preferably from 1 to 3 carbon atoms, the pH of said aqueous solution being ranging from 0.6 to 1.6, preferably ranging from 0.9 to 1.3.

For the aim of the present description and of the following claims, the definitions of the numerical ranges always comprise the extremes unless otherwise specified.

For the aim of the present description and of the following claims, the term "comprising" also includes the terms "which essentially consists of" or "which consists of".

For the aim of the present description and of the following claims, the term "sugar having from 5 to 6 carbon atoms" refers to a pentose sugar, or more simply a pentose, which is a monosaccharide carbohydrate composed of five carbon atoms having the chemical formula $C_5H_{10}O_5$, and a hexose sugar, or more simply a hexose, which is a monosaccharide carbohydrate composed of six carbon atoms having the chemical formula $C_6H_{12}O_6$, respectively.

According to a preferred embodiment of the present invention, said polysaccharide can be selected from cellulose, hemicellulose, or mixtures thereof. Hemicellulose, or mixtures of hemicellulose and cellulose, are particularly preferred.

According to a further preferred embodiment of the present invention, said biomass is a lignocellulosic biomass. As already reported above, lignocellulosic biomass comprises three components: hemicellulose, cellulose and lignin.

Preferably, said lignocellulosic biomass can be selected from:

- products of crops expressly cultivated for energy use (for example, miscanthus, foxtail millet, common cane), including waste products, residues and scraps of said crops or of their processing;
- products of agricultural cultivations, of forestation and of silviculture, comprising wood, plants, residues and waste products of agricultural processing, of forestation and of silviculture;
- waste of agro-food products destined for human nutrition or zootechnics;
- residues, not treated chemically, of the paper industry;
- waste products coming from the differentiated collection of solid urban waste (e.g., urban waste of a vegetable origin, paper).

According to a particularly preferred embodiment of the present invention, said lignocellulosic biomass can be selected from: guayule (*Parthenium argentatum*), thistle (*Cynara cardunculus* L.), conifers (pines, fir trees).

According to a preferred embodiment of the present invention, said biomass can be subjected to a preliminary grinding process before being put in contact with said aqueous solution of at least one organic acid. Said biomass can be preferably ground until particles having a diameter ranging from 0.1 mm to 10 mm, more preferably ranging from 0.5 mm to 4 mm, are obtained. Particles having a diameter of less than 2 mm are particularly preferred.

According to a preferred embodiment of the present invention, said at least one organic acid can be selected from alkyl-sulfonic acids having general formula (I):

$$R—SO_3H \quad (I)$$

wherein R represents a linear or branched $C_1$-$C_6$, preferably $C_1$-$C_3$, alkyl group.

According to a particularly preferred embodiment of the present invention, said at least one organic acid is methanesulfonic acid ($CH_3$—$SO_3H$).

According to a preferred embodiment of the present invention, said process for the production of sugars from biomass comprises:

putting a biomass in contact with an aqueous solution of said at least one organic acid in a reactor obtaining a first reaction mixture;

heating the reactor to the desired temperature, preferably ranging from 100° C. to 180° C., more preferably ranging from 130° C. to 150° C., for a time ranging from 20 minutes to 2 hours, preferably ranging from 40 minutes to 1 hour, obtaining a second reaction mixture comprising a first solid phase and a first aqueous phase;

optionally, maintaining said second reaction mixture comprising a first solid phase and a first aqueous phase at said desired temperature for a time ranging from 30 seconds to 1 hour, preferably ranging from 5 minutes to 20 minutes;

removing said second reaction mixture from said reactor.

According to a preferred embodiment of the present invention, said biomass can be present in said first reaction mixture in a quantity ranging from 5% by weight to 40% by weight, preferably from 20% by weight to 35% by weight, with respect to the total weight of said first reaction mixture.

For the aim of the present invention, said reactor can be selected from reactors known in the art such as, for example, autoclaves, fixed-bed reactors, slurry reactors with continuous feeding of the biomass (CSTR—"Continuous Stirred-Tank Reactors"), extruders.

According to a preferred embodiment of the present invention, said reactor is selected from slurry reactors with continuous feeding of the biomass (CSTR—"Continuous Stirred-Tank Reactors").

According to a preferred embodiment of the present invention, said first solid phase comprises lignin and cellulose and said first aqueous phase comprises at least one sugar having from 5 to 6 carbon atoms and said at least one organic acid. Said at least one organic acid is the organic acid which is put in contact with the biomass. Said at least one sugar is, in particular, xylose. Said xylose derives from the acid hydrolysis of hemicellulose. Arabinose, mannose, galactose, glucose, can also be present in said first aqueous phase.

Said first solid phase and said first aqueous phase can be separated by means of techniques known in the art such as, for example, filtration, centrifugation. Said phases are preferably separated by filtration.

In order to recover said sugar having from 5 to 6 carbon atoms and said at least one organic acid from said first aqueous phase, said first aqueous phase can be subjected to treatments known in the art. Said first aqueous phase, for example, can be subjected to a separation step by means of resins, as described, for example, in American patents U.S. Pat. No. 5,726,046 and U.S. Pat. No. 5,820,687; or it can be subjected to an extraction step with an organic solvent insoluble in water as described, for example, in International patent applications WO 2010/015404 and WO 2010/069583, reported above. At the end of said steps, a second solid phase comprising said organic acid and a second aqueous phase comprising at least one sugar having from 5 to 6 carbon atoms, is obtained.

Said organic acid can then be subsequently re-used according to the process object of the present invention.

Said second aqueous phase comprising at least one sugar having from 5 to 6 carbon atoms, can be used as such, or in a mixture with solutions particularly rich in sugars having 6 carbon atoms, in fermentation processes for the production of alcohols (e.g., ethanol, butanol). Said alcohols can be advantageously used as biofuels for motor vehicles, or as components that can be added to fuels for motor vehicles. Alternatively, said second aqueous phase comprising at least a sugar having from 5 to 6 carbon atoms, can be used as such, or in a mixture with solutions particularly rich in sugars having 6 carbon atoms, in fermentation processes for the production of lipids. Said lipids can be advantageously used in the production of biodiesel or green diesel that can be used as such, or in a mixture with other fuels for motor vehicles.

The present invention also relates to a process for the production of sugars from biomass as reported above, wherein said sugars can be used as carbon sources in fermentation processes for the production of alcohols (e.g., ethanol, butanol), diols (e.g., 1,3-propanediol, 1,3-butanediol, 1,4-butanediol, 2,3-butanediol), lipids, or other intermediates or products.

Moreover, the present invention also relates to the use of said alcohols, diols, lipids, or other intermediates or products, in the chemical industry or in the formulation of fuels for motor vehicles, as well as to the use of said alcohols and of said diols in the bio-butadiene production.

As already reported above, the process object of the present invention, allows to obtain at least one sugar having from 5 to 6 carbon atoms, in particular at least one sugar having 5 carbon atoms such as xylose, arabinose, deriving from the acid hydrolysis of hemicellulose, with a high yield. More specifically, said process allows a yield of sugars having from 5 to 6 carbon atoms higher than or equal to 95% to be obtained, said yield being calculated with respect to the total quantity of hemicellulose present in the starting biomass. Furthermore, the process object of the present invention, allows a content (%) of sugars having from 5 to 6 carbon atoms higher than or equal to 70% to be obtained, said content being calculated as described hereunder.

The process object of the present invention, also allows high yields of cellulose and of lignin to be obtained.

Said first solid phase comprising cellulose and lignin, obtained according to the process object of the present invention, can be used in an enzymatic hydrolysis process, in order to hydrolyze the cellulose to glucose. The enzymatic hydrolysis process can be carried out according to techniques known in the art as described, for example, in American patents U.S. Pat. No. 5,628,830, U.S. Pat. No. 5,916,780 and U.S. Pat. No. 6,090,595, using commercial enzymes such as, for example, Celluclast 1.5 L (Novozymes), Econase CE (Rohm Enzymes), Spezyme (Genecor), Novozym 188 (Novozymes), used individually or mixed with each other.

A third solid phase comprising lignin and a third aqueous phase comprising glucose deriving from the hydrolysis of cellulose, are obtained from the enzymatic hydrolysis of said first solid phase.

Said third solid phase and said third liquid phase can be separated by means of techniques known in the art such as, for example, filtration, centrifugation. Said phases are preferably separated by filtration.

Said third aqueous phase comprising glucose can be used as such, or in a mixture with solutions particularly rich in sugars having 5 carbon atoms, as raw material in fermentation processes for the production of alcohols (e.g., ethanol, butanol). Said alcohols can be advantageously used as biofuels for motor vehicles, or as components that can be added to fuels for motor vehicles. Alternatively, said third aqueous phase comprising glucose can be used as such, or in a mixture with solutions particularly rich in sugars having 5 carbon atoms, in fermentation processes for the production of lipids. Said lipids can be advantageously used in the production of biodiesel or green diesel which can be used as such, or in a mixture with other fuels for motor vehicles.

Said third solid phase, comprising lignin, can be upgraded as fuel, for example as fuel for producing the energy necessary for sustaining the treatment processes of the biomass.

Fermentation processes are described in the art, such as, for example, in American patent application US 2013/0224333 and in International patent application WO 2008/141317 (fermentation in the presence of yeasts); or in American patent application US 2010/0305341 and in International patent application WO 2011/051977 (fermentation in the presence of genetically modified oleaginous yeasts); or in International patent application WO 2010/127319 (fermentation in the presence of genetically modified microorganisms).

Some illustrative and non-limiting examples are provided hereunder for a better understanding of the present invention and for its practical embodiment.

Analysis and Characterization Methods

The analysis and characterization methods reported hereunder were used.

Analysis of the Starting Biomass

The starting biomass was analyzed by means of the Van Soest fiber fraction system by quantification of the constituents of the cell walls, in particular hemicellulose, cellulose and lignin, as described, for example, in Van Soest, P. J. and Wine, R. H. "Use of detergents in the analysis of fibrous feeds. IV. Determination of plant cell-wall constituents", "Journal of Association of Official Analytical Chemistry" (1967), Vol. 50, pages 50-55.

Analyses of the Compounds Present in the First Aqueous Phase

The analyses of the sugars present in the first aqueous phase were carried out by means of ion chromatography using the following operational conditions:

- instrument: Dionex IC3000, column PA100;
- eluent: sodium hydroxide (NaOH) (100 mM)-sodium acetate ($CH_3COONa$) 0.6 M in 200 mM of sodium hydroxide (NaOH);
- elution program: gradient, electrochemical detector.

The analyses of the by-products, i.e. furfural (F) and hydroxy-methyl-furfural (HMF) present in the first aqueous phase, were carried out by means of liquid chromatography using the following operational conditions:

- instrument: HP 1100, column Inertsil C18;
- eluent: phosphoric acid 0.01 M-acetonitrile ($CH_3CN$);
- elution program: gradient, UV-DAD detector.

Calculation of the Yield, Content of the Sugars Having 5 Carbon Atoms and of the Production of by-Products The yield was expressed, on the basis of the analytical results (i.e. the analysis of the compounds present in the first aqueous phase carried out as described above), as a percentage ratio between the sugars having 5 and 6 carbon atoms [i.e. pentoses ($C_5$) and hexoses ($C_6$), respectively] present in said first aqueous phase, with respect to the total quantity of hemicellulose contained in the starting biomass, according to the following formula:

$$(mC_5+mC_6)/m\text{HEMICELLULOSE}*100 \qquad \text{Yield:}$$

wherein:

$C_5$=pentoses present in solution;

$C_6$=hexoses present in solution;

m=molecular weight of the compound;

HEMICELLULOSE=hemicellulose contained in the starting biomass.

The content (%) of sugars having 5 carbon atoms (i.e. pentoses) present in the first aqueous phase was also determined, for each example, according to the following formula:

$$mC_5/(mC_5+mC_6)*100 \qquad \text{Content } C_5\text{:}$$

wherein $C_5$, $C_6$ and m, have the same meanings described above.

In order to express the production of by-products i.e. hydroxy-methyl-furfural (HMF) and furfural (F), effectively, the degradation ratios were calculated according to the following formulae:

$$m\text{HMF}/(mC_6+m\text{HMF})*100 \qquad \text{Degradation ratio } C_6\text{:}$$

$$m\text{F}/(mC_5+m\text{F})*100 \qquad \text{Degradation ratio } C_5\text{:}$$

wherein $C_5$, $C_6$ and m, have the same meanings described above;

F=furfural;

HMF=hydroxy-methyl-furfural.

EXAMPLE 1 (INVENTION)

25 g of previously ground coniferous wood (particle diameter <2 mm) were charged into an open-top Büchi autoclave type 3E/1.01t.

500 g of an aqueous solution of methane-sulfonic acid ($CH_3$—$SO_3H$), at pH 1.1, were then charged. The first reaction mixture thus obtained was kept under vigorous stirring (600 revs/min), until a temperature of 140° C. had been reached, over a period of 45 minutes, obtaining a second reaction mixture comprising a first solid phase containing lignin and cellulose and a first aqueous phase containing sugars deriving from hemicellulose.

After leaving the autoclave to cool to room temperature (23° C.), said phases were separated by filtration.

The composition of the starting biomass, determined as described above, was the following: 45.1% by weight of cellulose, 25.2% by weight of hemicellulose, 24.4% by weight of lignin, with respect to the total weight of the starting biomass. The remaining part proved to consist of organic acids, protein and non-protein nitrogenous substances, lipids, mineral salts.

The first aqueous phase was analyzed as described above, obtaining the following results:

yield: 97.6% (with respect to the total quantity of hemicellulose contained in the starting biomass);

degradation ratio $C_6$:1.9%;

degradation ratio $C_5$:0.9%;

$C_5$ content: 83.7%.

EXAMPLE 2 (INVENTION)

25 g of previously ground thistle bagasse (*Cynara cardunculus* L.) (particle diameter<2 mm) were charged into an open-top Büchi autoclave type 3E/1.01t.

500 g of an aqueous solution of methane-sulfonic acid ($CH_3$—$SO_3H$), at pH 1.1, were then charged. The first reaction mixture thus obtained was kept under vigorous stirring (600 revs/min), until a temperature of 140° C. had been reached, over a period of 45 minutes, obtaining a second reaction mixture comprising a first solid phase containing lignin and cellulose and a first aqueous phase containing sugars deriving from hemicellulose.

After leaving the autoclave to cool to room temperature (23° C.), said phases were separated by filtration.

The composition of the starting biomass, determined as described above, was the following: 41.2% by weight of cellulose, 17.5% by weight of hemicellulose, 25.7% by weight of lignin, with respect to the total weight of the starting biomass. The remaining part proved to consist of organic acids, protein and non-protein nitrogenous substances, lipids, mineral salts.

The first aqueous phase was analyzed as described above, obtaining the following results:

yield: 96.1% (with respect to the total quantity of hemicellulose contained in the starting biomass);

degradation ratio $C_6$: 1.4%;

degradation ratio $C_5$: 0.9%;

$C_5$ content: 74.3%.

EXAMPLE 3 (INVENTION)

25 g of previously ground guayule bagasse (*Parthenium argentatum*) (particle diameter <2 mm) were charged into an open-top Büchi autoclave type 3E/1.01t.

500 g of an aqueous solution of methane-sulfonic acid ($CH_3$—$SO_3H$), at pH 1.1, were then charged. The first reaction mixture thus obtained was kept under vigorous stirring (600 revs/min), until a temperature of 140° C. had been reached, over a period of 45 minutes, obtaining a second reaction mixture comprising a first solid phase containing lignin and cellulose and a first aqueous phase containing sugars deriving from hemicellulose.

After leaving the autoclave to cool to room temperature (23° C.), said phases were separated by filtration.

The composition of the starting biomass, determined as described above, was the following: 42.9% by weight of cellulose, 21.2% by weight of hemicellulose, 26.3% by weight of lignin, with respect to the total weight of the starting biomass. The remaining part proved to consist of organic acids, protein and non-protein nitrogenous substances, lipids, mineral salts.

The first aqueous phase was analyzed as described above, obtaining the following results:

yield: 98.8% (with respect to the total quantity of hemicellulose contained in the starting biomass);

degradation ratio $C_6$: 0.0%;

degradation ratio $C_5$: 1.6%;

$C_5$ content: 80.6%.

EXAMPLE 4 (COMPARATIVE)

25 g of previously ground coniferous wood (particle diameter <2 mm) were charged into an open-top Büchi autoclave type 3E/1.01t.

500 g of an aqueous solution of p-toluenesulfonic acid ($CH_3C_6H_4$—$SO_3H$), at pH 1.1, were then charged. The first reaction mixture thus obtained was kept under vigorous stirring (600 revs/min), until a temperature of 140° C. had been reached, over a period of 45 minutes, obtaining a second reaction mixture comprising a first solid phase containing lignin and cellulose and a first aqueous phase containing sugars deriving from hemicellulose.

After leaving the autoclave to cool to room temperature (23° C.), said phases were separated by filtration.

The composition of the starting biomass, determined as described above, was the following: 45.1% by weight of cellulose, 25.2% by weight of hemicellulose, 24.4% by weight of lignin, with respect to the total weight of the starting biomass. The remaining part proved to consist of organic acids, protein and non-protein nitrogenous substances, lipids, mineral salts.

The first aqueous phase was analyzed as described above, obtaining the following results:

yield: 83.6% (with respect to the total quantity of hemicellulose contained in the starting biomass);

degradation ratio $C_6$: 5.0%;

degradation ratio $C_5$: 3.7%;

$C_5$ content: 77.3%.

EXAMPLE 5 (COMPARATIVE)

25 g of previously ground thistle bagasse (*Cynara cardunculus* L.) (particle diameter <2 mm) were charged into an open-top Büchi autoclave type 3E/1.01t.

500 g of an aqueous solution of p-toluenesulfonic acid ($CH_3C_6H_4$—$SO_3H$), at pH 1.1, were then charged. The first reaction mixture thus obtained was kept under vigorous stirring (600 revs/min), until a temperature of 140° C. had been reached, over a period of 45 minutes, obtaining a second reaction mixture comprising a first solid phase containing lignin and cellulose and a first aqueous phase containing sugars deriving from hemicellulose.

After leaving the autoclave to cool to room temperature (23° C.), said phases were separated by filtration.

The composition of the starting biomass, determined as described above, was the following: 41.2% by weight of cellulose, 17.5% by weight of hemicellulose, 25.7% by weight of lignin, with respect to the total weight of the starting biomass. The remaining part proved to consist of organic acids, protein and non-protein nitrogenous substances, lipids, mineral salts.

The first aqueous phase was analyzed as described above, obtaining the following results:

yield: 88.1% (with respect to the total quantity of hemicellulose contained in the starting biomass);

degradation ratio $C_6$: 3.8%;

degradation ratio $C_5$: 8.8%;

$C_5$ content: 72.9%.

EXAMPLE 6 (COMPARATIVE)

25 g of previously ground guayule bagasse (*Parthenium argentatum*) (particle diameter <2 mm) were charged into an open-top Büchi autoclave type 3E/1.01t.

500 g of an aqueous solution of p-toluenesulfonic acid ($CH_3C_6H_4$—$SO_3H$), at pH 1.1, were then charged. The first reaction mixture thus obtained was kept under vigorous stirring (600 revs/min), until a temperature of 140° C. had been reached, over a period of 45 minutes, obtaining a second reaction mixture comprising a first solid phase containing lignin and cellulose and a first aqueous phase containing sugars deriving from hemicellulose.

After leaving the autoclave to cool to room temperature (23° C.), said phases were separated by filtration.

The composition of the starting biomass, determined as described above, was the following: 42.9% by weight of cellulose, 21.2% by weight of hemicellulose, 26.3% by weight of lignin, with respect to the total weight of the starting biomass. The remaining part proved to consist of organic acids, protein and non-protein nitrogenous substances, lipids, mineral salts.

The first aqueous phase was analyzed as described above, obtaining the following results:

yield: 91.2% (with respect to the total quantity of hemicellulose contained in the starting biomass);

degradation ratio $C_6$: 0.0%;

degradation ratio $C_5$: 4.8%;

$C_5$ content: 74.6%.

From the examples described above, it is evident that, operating under the same conditions, the yields of sugars having from 5 to 6 carbon atoms proved to be lower and the quantity of by-products [i.e. furfural (F) and hydroxymethyl-furfural (HMF)] proved to be higher, using p-toluenesulfonic acid [Examples 4-6 (comparative)], with respect to [Examples 1-3 (invention)] in which methane-sulfonic acid was used in accordance with the present invention.

The invention claimed is:

1. A process for the production of one or more sugars having from 5 to 6 carbon atoms from a biomass that comprises hemicellulose, the process comprising:

contacting said biomass with an aqueous solution comprising an organic acid having from 1 to 3 carbon atoms, wherein said aqueous solution has a pH ranging from 0.6 to 1.6, and wherein the organic acid is an alkyl-sulfonic acid having the formula R—$SO_3H$ where R represents a linear or branched $C_1$-$C_3$ alkyl group, and obtaining the one or more sugars having from 5 to 6 carbon atoms, wherein said process provides a yield of said one or more sugars having from 5 to 6 carbon atoms that is higher than or equal to 95%, said yield being calculated with respect to a total quantity of hemicellulose present in the starting biomass.

2. The process according to claim 1, wherein said biomass is a lignocellulosic biomass.

3. The process according to claim 2, wherein said lignocellulosic biomass is selected from the group consisting of material from guayule (*Parthenium argentatum*), thistle (*Cynara cardunculus* L.), conifers and mixtures thereof.

4. The process according to claim 1, wherein said biomass is subjected to a preliminary grinding process before contacting it with said aqueous solution.

5. The process according to claim 1, comprising contacting said biomass with an aqueous solution comprising an organic acid having from 1 to 2 carbon atoms, wherein R represents a linear or branched $C_1$-$C_2$ alkyl group.

6. The process according to claim 5, wherein said organic acid is methane-sulfonic acid ($CH_3$—$SO_3H$).

7. The process according to claim 1, wherein said process comprises:

a. contacting the biomass with the aqueous solution in a reactor thus obtaining a first reaction mixture;

b. heating the first reaction mixture in the reactor to a desired temperature for a time ranging from 20 minutes to 2 hours, thus obtaining a second reaction mixture comprising a first solid phase and a first aqueous phase;

c. optionally, maintaining said second reaction mixture at said desired temperature for a time ranging from 30 seconds to 1 hour; and d. removing said second reaction mixture from said reactor.

8. The process according to claim 7, wherein said biomass is present in said first reaction mixture in a quantity ranging from 5% by weight to 40% by weight with respect to the total weight of said first reaction mixture.

9. The process according to claim 7, wherein said reactor is a reactor with continuous feeding of the biomass.

10. The process according to claim 7, wherein said first solid phase comprises lignin and cellulose and said first aqueous phase comprises at least one sugar having from 5 to 6 carbon atoms and said organic acid.

11. The process of claim 1, wherein said aqueous solution has a pH ranging from 0.9 to 1.3.

12. The process of claim 2, wherein said lignocellulosic biomass is selected from the group consisting of:

a product of a *miscanthus*, foxtail millet, or common cane crop or another crop expressly cultivated for energy use, or a waste product, residue or scraps of said crop or of its processing;

a product of agricultural cultivations, forestation and silviculture, comprising wood, plants, residues or waste products of agricultural processing, of forestation or of silviculture;

waste of agro-food products destined for human nutrition or zootechnics;

residues, not chemically treated, of the paper industry;

waste products coming from a differentiated collection of urban waste paper, urban waste of vegetable origin or other solid urban waste, and mixtures thereof.

13. The process of claim 7, wherein said desired temperature ranges from 100° C. to 180° C.

14. The process of claim 7, wherein said desired temperature ranges from 130° C. to 150° C.

15. The process of claim 1, wherein said aqueous solution has a pH ranging from 0.6 to 1.6 and consists essentially of water and the organic acid.

16. The process of claim 1, wherein said aqueous solution has a pH ranging from 0.6 to 1.6 and consists of water and the organic acid.

* * * * *